US007692122B2

(12) United States Patent
Lewin et al.

(10) Patent No.: US 7,692,122 B2
(45) Date of Patent: Apr. 6, 2010

(54) HEAT CONDUCTOR SUPPORT DISC

(75) Inventors: Thomas Lewin, Hallstahammar (SE); Anke Krönert, Skultuna (SE); Sune Linden, Västerås (SE)

(73) Assignee: Sandvik Intellectual Property AB, Sandviken (SE)

( * ) Notice: Subject to any disclaimer, the term of this patent is extended or adjusted under 35 U.S.C. 154(b) by 818 days.

(21) Appl. No.: 10/562,609

(22) PCT Filed: Jun. 23, 2004

(86) PCT No.: PCT/SE2004/001019

§ 371 (c)(1),
(2), (4) Date: Apr. 7, 2006

(87) PCT Pub. No.: WO2005/001361

PCT Pub. Date: Jan. 6, 2005

(65) Prior Publication Data

US 2006/0219703 A1 Oct. 5, 2006

(30) Foreign Application Priority Data

Jun. 27, 2003 (SE) ..... 0301930

(51) Int. Cl.
*H05B 3/02* (2006.01)
*H05B 3/60* (2006.01)

(52) U.S. Cl. ..... 219/520; 219/521; 219/523; 219/546; 219/548; 219/538; 219/550; 219/506; 373/132; 373/133; 373/134

(58) Field of Classification Search ..... 219/520–1, 219/523, 546, 548, 538, 550, 506; 373/127, 373/132–134

See application file for complete search history.

(56) References Cited

U.S. PATENT DOCUMENTS

| | | | | |
|---|---|---|---|---|
| 2,888,546 | A * | 5/1959 | Kinney | 392/441 |
| 3,395,241 | A | 7/1968 | Roman | 373/128 |
| 3,879,167 | A | 4/1975 | De Luca et al. | 432/249 |
| 4,179,603 | A | 12/1979 | Zeigler et al. | 219/538 |
| 4,215,233 | A | 7/1980 | Kastilahn | 373/127 |
| 5,543,603 | A | 8/1996 | Schmädig et al. | 219/550 |

FOREIGN PATENT DOCUMENTS

FR 2 577 099 A1 8/1986

* cited by examiner

*Primary Examiner*—Shawntina Fuqua
(74) *Attorney, Agent, or Firm*—Alfred J. Mangels

(57) ABSTRACT

A ceramic heat conductor support disc for supporting an electrical heating element for electrically heated furnace installations. The support disc has a center aperture lying parallel to the longitudinal axis of the heating element, and one or more apertures located between the center aperture and the periphery of the disc. The disc is provided with one or more elongated openings running from the periphery to one of the apertures or to the center aperture, wherein each elongated opening penetrates the entire thickness of the disc.

11 Claims, 5 Drawing Sheets

HEAT CONDUCTOR SUPPORT DISC

BACKGROUND OF THE INVENTION

1. Field of the Invention

The present invention relates to the field of heating elements for industrial furnace applications, and in particular to an improved heat conductor support disc for use in a heating element.

2. Description of the Related Art

In industrial furnaces employed in the processing of materials and products at high temperatures, electrical heating elements are positioned and supported by ceramic discs. Typically, the heating resistor elements or heat conductors are inserted through apertures in the discs. In such discs, a center aperture for a supporting element is located on a symmetrical axis in the center of the disc. Apertures for heat conductors are provided uniformly distributed on at least one circle coaxial with a respective disc center. During service such discs tend to break due to thermal stresses induced in the disc.

The prior art can be exemplified by U.S. Pat. No. B1 5,543,603, which hereby is incorporated by reference. This US patent shows discs as described above.

An object of the present invention is to provide a ceramic heat conductor support disc for supporting electrical heating elements for heating furnaces, which discs have a much lower tendency to break due to thermal stresses.

SUMMARY OF THE INVENTION

The present invention relates to a ceramic heat conductor support disc for supporting an electrical heating element for electrically heated furnace installations. The support disc has a center aperture lying parallel to the longitudinal axis of the heating element, and one or more apertures located between said center aperture and the periphery of the disc. The disc is provided with one or more elongated openings running from said periphery to one of said apertures, where each elongated opening penetrates the whole thickness of said disc.

It is another object of the present invention to provide a heat conductor support disc which allows higher energy rates to the elements.

It is still another object of the present invention to provide an improved heat conductor support disc for use at higher temperatures.

It is yet another object of the present invention to provide a heat conductor support disc with improved properties at higher thermal cycling rates.

BRIEF DESCRIPTION OF THE DRAWINGS

The structure, operation, and advantages of the present invention will become further apparent upon consideration of the following description, taken in conjunction with the accompanying drawings in which.

DESCRIPTION OF THE PREFERRED EMBODIMENTS

Figure 1A:
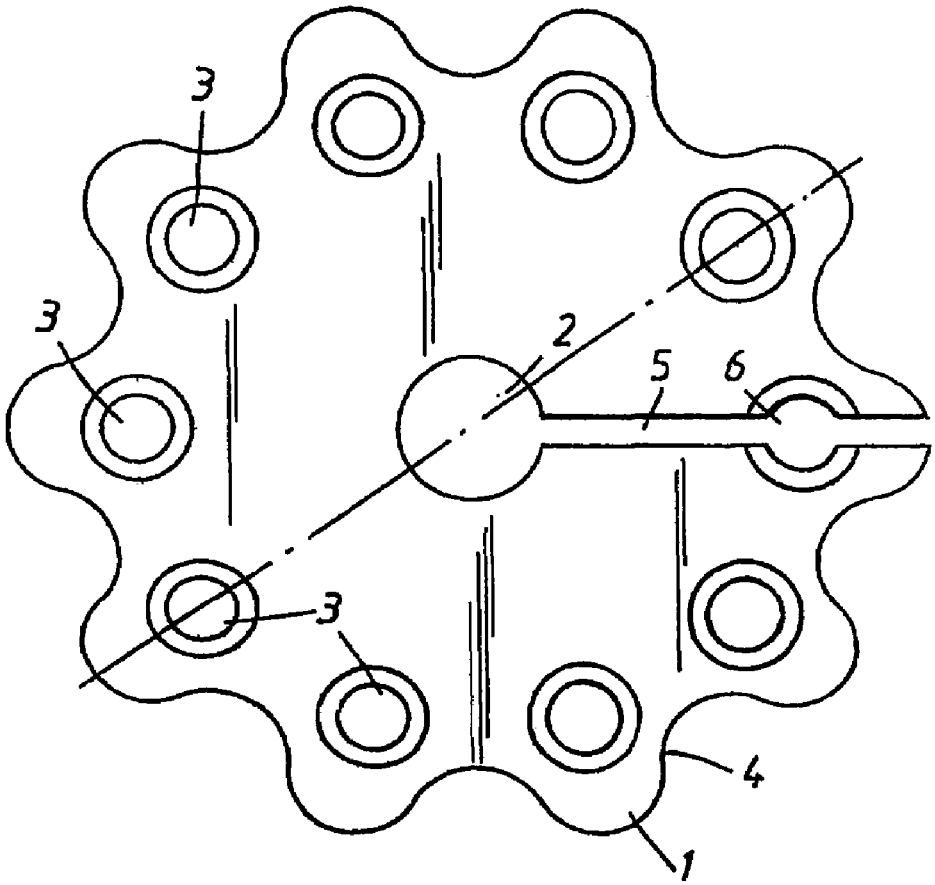
FIGS. 1A and 1B show plan and cross-sectional views, respectively, of a first embodiment of a ceramic disc according to the present invention.
Figure 1B:
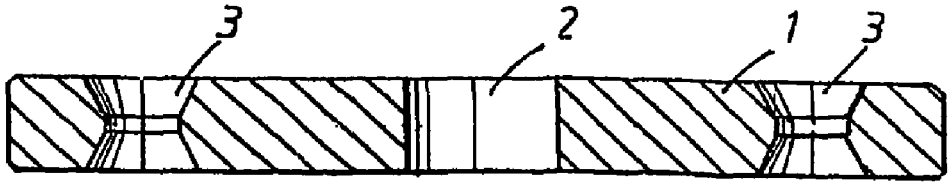

In FIG. 1A a ceramic heat conductor support disc 1 for supporting an electrical heating element for electrically heated furnace installations is shown in a plan view. Said support disc 1 has a center aperture 2 lying parallel to the longitudinal axis of the disc. Further, the disc 1 is provided with one or more intermediate apertures 3 and 6 located between said center aperture 2 and the periphery 4 of the disc. The apertures can be circular or can be of another shape, such as an elliptical aperture such as aperture 15 shown in FIG. 5A.

The periphery 4 can have a wave shape, as shown, or another shape such as circular.

According to the invention the disc 1 is further provided with one or more elongated openings 5 running from said periphery 4 through one of said apertures 6. The elongated opening penetrates the whole thickness of said disc 1.

An electrical heating element is supported by two or more discs 1 located in a row after each other, where the heating element runs through the said apertures.

The disc 1 is typically made of pure oxides or a mixture of oxides of the elements Al, Si, Mg, Zr, and/or Y, nitrides, respectively borides of the elements Si and/or Ti, or other suitable heat resistant ceramic materials.

A preferred embodiment can comprise 40-100 weight-% $Al_2O_3$ and 60-0% $SiO_2$ plus some additives, such as for promoting the process when the disc is sintered.

The elongated opening and/or openings can be produced by pressing, sawing or extruding processes before or after firing.

Typically the heating element has a temperature that is higher than the temperature of the furnace when operated. When the furnace is turned off, the temperature of the heating element will decrease to about the furnace temperature. There are such applications where the furnace is cyclically turned on and off, i.e., exposed to extremely high cyclic thermal stress. There are also applications where the elements are operating continuously, where extremely high cyclic thermal stress occurs during, e.g., the changing of elements.

In accordance with the invention mechanical stresses that are induced thermally, when the disc is heated to its operating temperature, and those that are induced when the temperature of the disc varies, will not reach the critical value for initiating a crack starting from the periphery of the disc and running inwardly.

The maximum value of such stresses is limited by means of the presence of the elongated opening 5, which results in that the thermally induced tensile stresses at the periphery will be limited.

According to a preferred embodiment of the invention, the length of said elongated opening 5 is limited to the maximum radius of the disc 1.

Figure 3B:
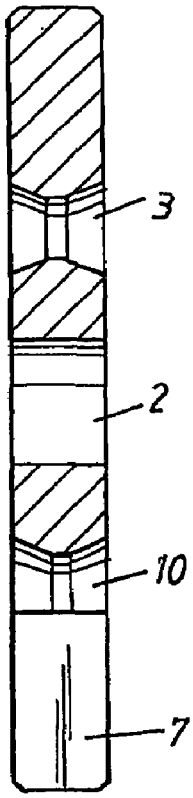
FIGS. 3A and 3B show plan and cross-sectional views, respectively, of a third embodiment of a ceramic disc according to the present invention.
Figure 3A:
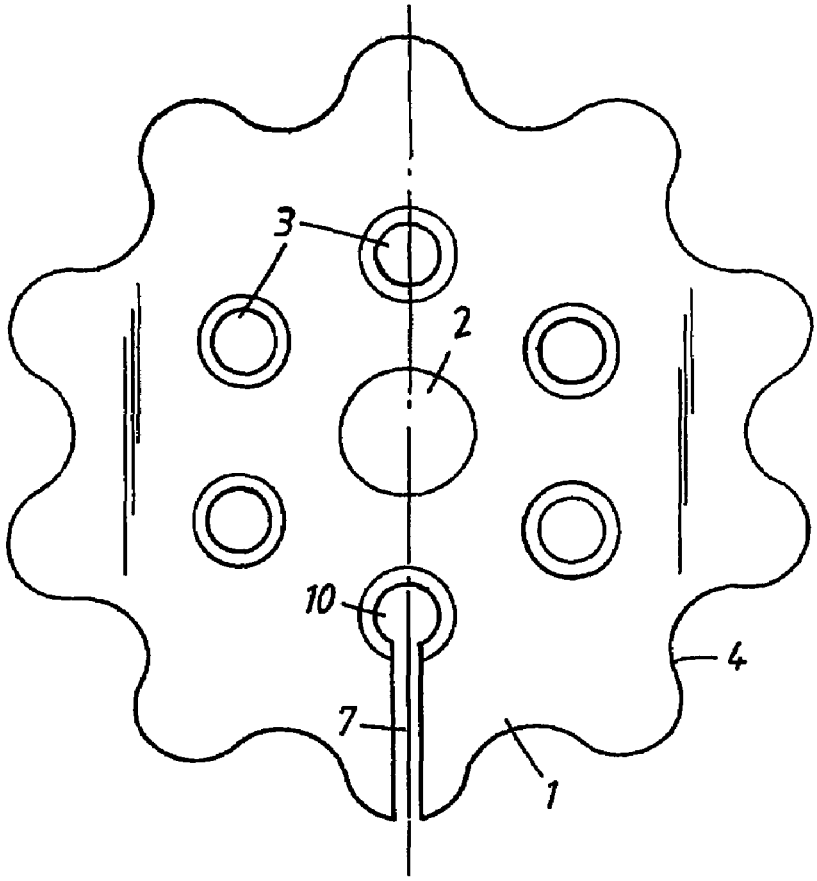

According to one embodiment, said elongated opening runs along a radius of said disc 1, as illustrated in FIGS. 1A and 3A by the openings 5 and 7.

Figure 2B:
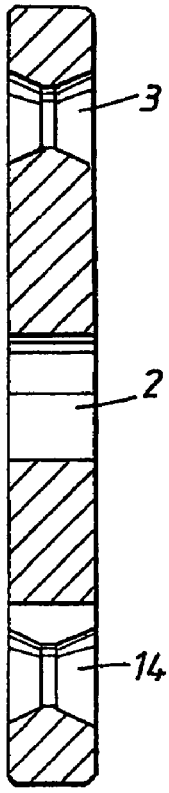
FIGS. 2A and 2B show plan and cross-sectional views, respectively, of a second embodiment of a ceramic disc according to the present invention.
Figure 2A:
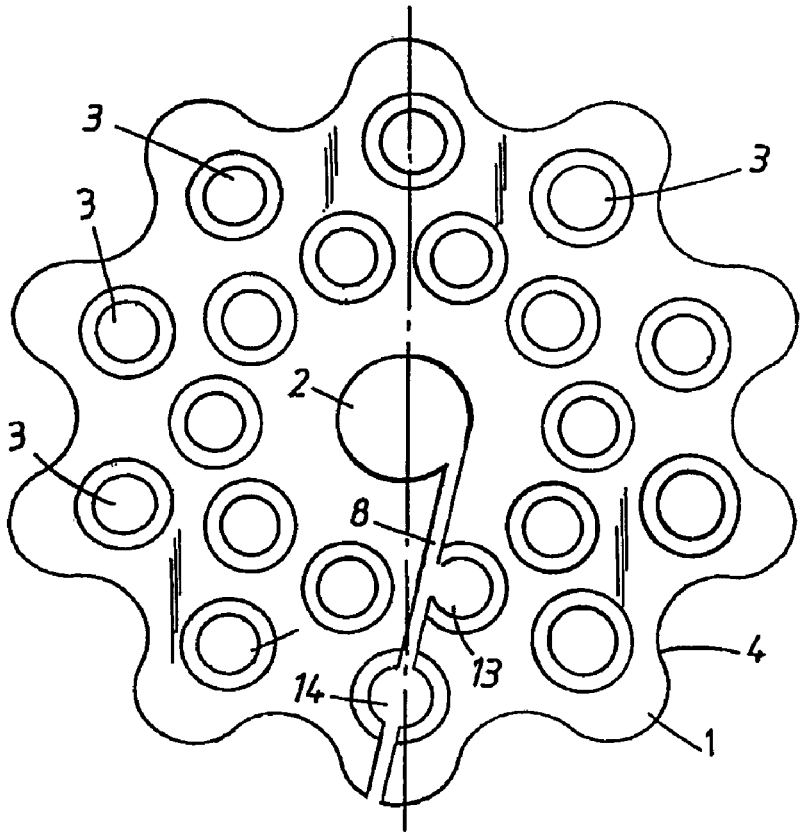
Figure 4B:
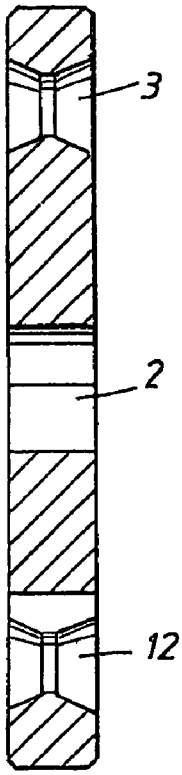
FIGS. 4A and 4B show plan and cross-sectional views, respectively, of a fourth embodiment of a ceramic disc according to the present invention.
Figure 4A:
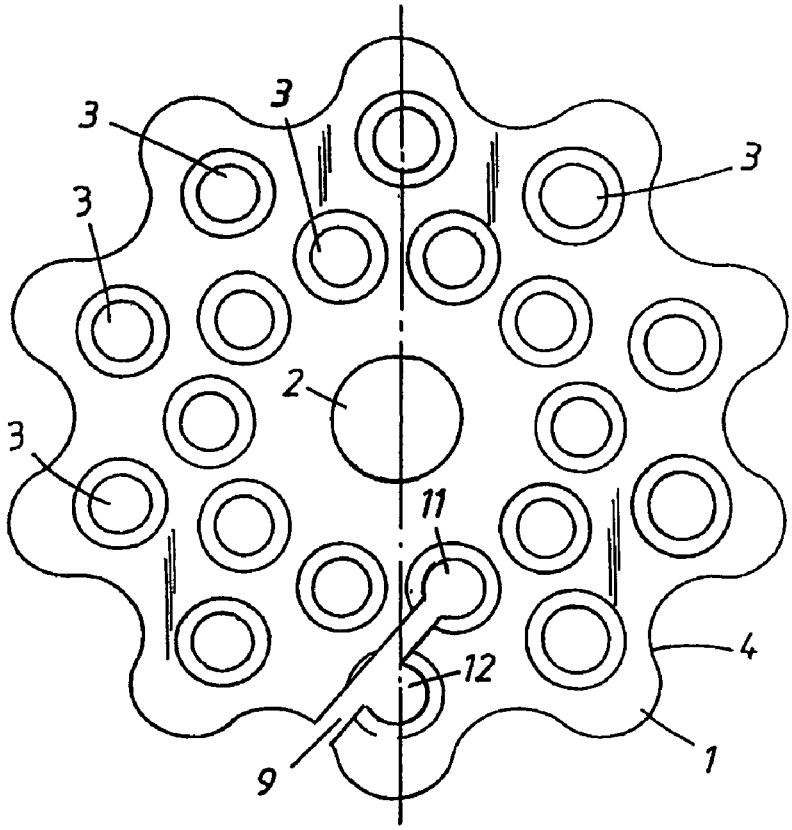

According to an alternative embodiment, said elongated opening runs in another direction than along a radius of said disc 1, as illustrated in FIGS. 2A and 4A by the openings 8, 9.

According to another preferred embodiment, the width of the elongated opening 5, 7, 8, 9 is limited to the diameter of the aperture 6, 2, 10, and 11 in which it ends.

As is shown in FIGS. 2A and 4A, the elongated openings 8, 9 can well run through apertures 12, 13, 14

According to still another preferred embodiment, the elongated opening has the same width, or a width that varies, over the length of the elongated opening.

According to yet another preferred embodiment, said elongated opening ends in the center aperture 2, as illustrated in FIGS. 1A and 2A.

Figure 5A:
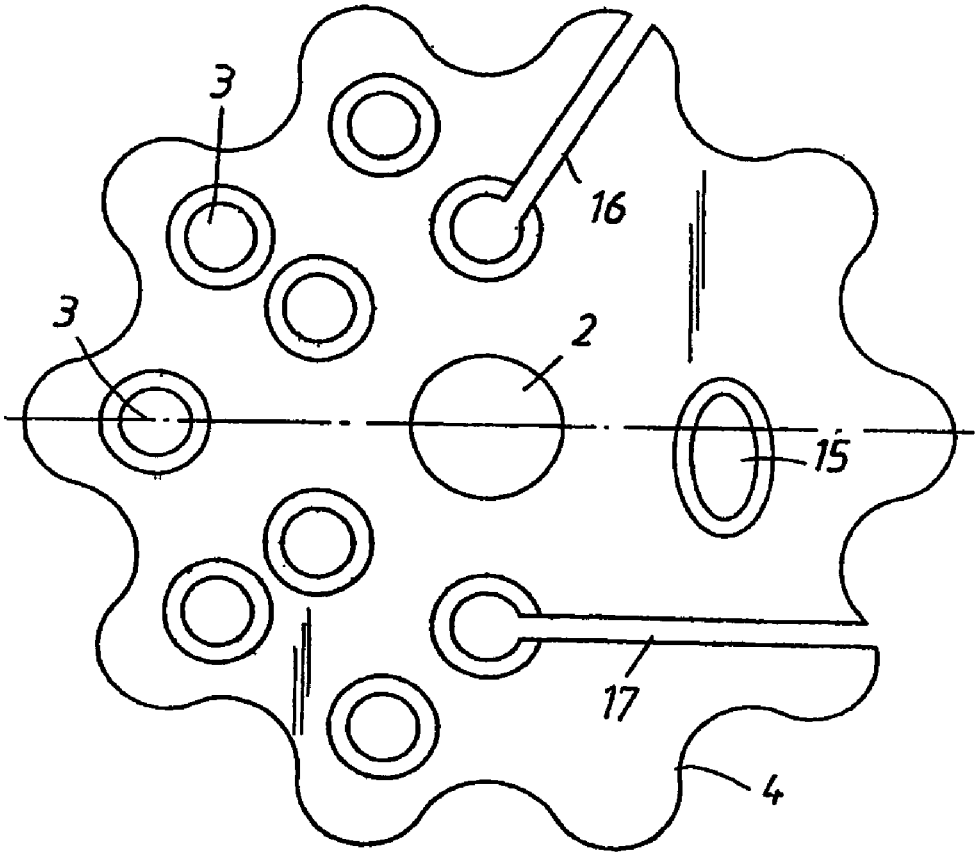
FIGS. 5A and 5B show plan and cross-sectional views, respectively, of a fourth embodiment of a ceramic disc according to the present invention.
Figure 5B:
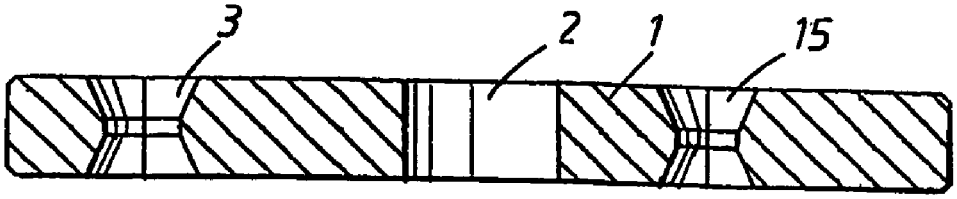

According to yet another embodiment of the invention, there are two or more of said elongated openings 16, 17 in the disc 1 as illustrated in FIG. 5A.

In FIG. 5A it is shown that the holes 3 can be asymmetrically located, as well as that the two elongated openings 16, 17 can be directed in different directions. The apertures 3 can be concentrated to one side of the disc, thereby concentrating the radiation in that direction.

Since there is one or more elongated openings in said disc, values relating to the maximum mechanical stress for a disc 1 of the present invention are in a range of no more than 50-70% of the stress in a disc of the state of the art.

In addition the mechanical strength has different values in different directions, which is of importance for the positioning of the disk in the heating application. It is therefore advantageous to place the different discs, located one after the other along the length of the heating element, such that the discs are rotated so that the elongated openings of the respective discs point in different radial directions.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. A ceramic heat conductor support disc for supporting an electrical heating element for electrically heated industrial furnace installations, said support disc comprising: a disc body having a predetermined thickness; a center aperture having a central axis lying parallel to a longitudinal axis of the disc body and of a heating element; at least one intermediate aperture located between said center aperture and an outer periphery of the disc body; wherein the disc includes at least one elongated opening extending from said periphery to at least one of said intermediate apertures; wherein each elongated opening extends through the entire thickness of said disc and the number of elongated openings is less than the number of intermediate apertures; wherein the at least one elongated opening extends in a non-radial direction relative to the center of said disc body; and wherein the at least one elongated opening serves to reduce thermal stresses produced within the support disc during heating of the heating element to reduce thermally induced disc cracking during exposure of the support disc to furnace operating temperatures and to thermal cycling.

2. A support disc in accordance with claim 1, wherein the at least one elongated opening has a length that is less than a maximum radius of the disc body.

3. A support disc in accordance with claim 1, wherein the at least one elongated opening has a width that is smaller than a width of an aperture.

4. A support disc in accordance with claim 1, wherein the at least one elongated opening has a constant width.

5. A ceramic heat conductor support disc for supporting an electrical heating element for electrically heated industrial furnace installations, said support disc comprising: a disc body having a predetermined thickness; a center aperture having a central axis lying parallel to a longitudinal axis of the disc body and of a heating element; at least one intermediate aperture located between said center aperture and an outer periphery of the disc body; wherein the disc includes at least one elongated opening extending from said periphery to at least one of said intermediate apertures wherein each elongated opening extends through the entire thickness of said disc and the number of elongated openings is less than the number of intermediate apertures; wherein the at least one elongated opening terminates at the center aperture; and wherein the at least one elongated opening serves to reduce thermal stresses produced within the support disc during heating of the heating element to reduce thermally induced disc cracking during exposure of the support disc to furnace operating temperatures and to thermal cycling.

6. A support disc in accordance with claim 1, wherein the disc includes a plurality of elongated openings.

7. A support disc in accordance with claim 6, including a plurality of intermediate apertures and wherein the intermediate apertures are located asymmetrically over a surface of the disc.

8. A support disc in accordance with claim 1, wherein the center aperture and the intermediate apertures have an elliptical shape.

9. A support disc in accordance with claim 1, wherein the center aperture and the intermediate apertures have a circular shape.

10. A ceramic heat conductor support disc for supporting an electrical heating element for electrically heated industrial furnace installations, said support disc comprising: a disc body having a predetermined thickness; a center aperture having a central axis lying parallel to a longitudinal axis of the disc body and of a heating element; at least one intermediate aperture located between said center aperture and an outer periphery of the disc body; wherein the disc includes at least one elongated opening extending from said periphery to at least one of said intermediate apertures; wherein each elongated opening extends through the entire thickness of said disc. and the number of elongated openings is less than the number of intermediate apertures; wherein the at least one elongated opening extends from an outwardly-positioned intermediate aperture to an inwardly-positioned intermediate aperture, relative to the disc periphery; and wherein the at least one elongated opening serves to reduce thermal stresses produced within the support disc during heating of the heating element to reduce thermally induced disc cracking during exposure of the support disc to furnace operating temperatures and to thermal cycling.

11. A ceramic heat conductor support disc for supporting an electrical heating element for electrically heated industrial furnace installations, said support disc comprising: a disc body having a predetermined thickness; a center aperture having a central axis lying parallel to a longitudinal axis of the disc body and of a heating element; at least one intermediate aperture located between said center aperture and an outer periphery of the disc body; wherein the disc includes at least one elongated opening extending from said periphery to at least one of said intermediate apertures; wherein such elongated opening extends through the entire thickness of said disc and the number of elongated openings is less than the number of intermediate apertures; wherein the at least one elongated opening has a width that varies along the length of the elongated opening; and wherein the at least one elongated opening serves to reduce thermal stresses produced within the support disc during heating of the heating element to reduce thermally induced disc cracking during exposure of the support disc to furnace operating temperatures and to thermal cycling.

* * * * *